US005217764A

United States Patent [19]

Eich

[11] Patent Number: 5,217,764

[45] Date of Patent: Jun. 8, 1993

[54] FIRE PROTECTION GLAZING

[75] Inventor: August W. Eich, Witten-Herbede, Fed. Rep. of Germany

[73] Assignee: Eich Corporation, Los Angeles, Calif.

[21] Appl. No.: 699,475

[22] Filed: May 13, 1991

[30] Foreign Application Priority Data

Jun. 22, 1990 [DE] Fed. Rep. of Germany ..... 4019950
Jan. 30, 1991 [DE] Fed. Rep. of Germany ..... 4102696

[51] Int. Cl.[5] ..... E06B 3/24

[52] U.S. Cl. ..... 428/34; 428/192; 428/913; 428/921; 156/107; 156/109; 52/171; 52/788; 52/790

[58] Field of Search ..... 428/34, 192, 913, 921; 156/107, 109; 52/788, 789, 790, 171; 169/54; 220/88.1; 252/606, 609; 126/544

[56] References Cited

U.S. PATENT DOCUMENTS 4,808,452 2/1989 McShane ..... 428/34

*Primary Examiner*—Donald J. Loney

*Attorney, Agent, or Firm*—Dann, Dorfman, Herrell and Skillman

[57] ABSTRACT

At least two generally parallel transparent panes are provided with a spacer between them at their perimeter, which spacer holds a fire protection material which includes an intumescent material, an opaque finely divided material in a solid, liquid or gel-like form. The fire protection material reacts at a certain temperature and expands by intumescence into the space between the transparent panes coating the internal surfaces of the transparent panes and rendering them opaque. The spacer itself may be composed of fire protection material or may be a channel holding such material or hollow tubular structure with openings or may be a combination of these forms. The invention also includes the method of placing fire protection material in the spacer between panes of glazing material and when temperature reaches a predetermined level expelling the fire protection material into the space between the panes and coating their internal surfaces with an opaque coating.

17 Claims, 1 Drawing Sheet

FIRE PROTECTION GLAZING

The present invention relates to glazing materials providing fire protection for use in all types of construction requiring glazing. The invention permits one to see through the glazing under normal circumstances but provides blocking of light, flames, smoke and radiant heat transfer when fire occurs.

BACKGROUND OF THE INVENTION

One form of technology currently available for fire protection glazing employs two or more panes of glazing materials separated by means of a spacer around the perimeter of the panes. The cavity between the glazing panels is entirely filled with a transparent gel, that stays transparent at ambient temperature. A primer for better adherence of the gel layer to the inside of the glazing panes is applied to the inside of the glazing panels before the cavity is filled. Ultimately the gel tends to harden after a certain time and in the process may discolor or develop discontinuities or otherwise mar the appearance of glazing panels.

A major disadvantage of this prior art fire protection glazing is a relatively great weight commonly on the order of approximately 12 pounds per square foot. The weight is due to the thickness of the gel layer and to the weight of the glazing panels. The weight of the fire protection glazing complicates the many difficulties in handling and transportation of the panels or installation of panels at the construction site. Therefore the possibility of breakage and damage is very high during manual transportation on the construction site and during loading onto and unloading from trucks.

Greater weight also requires stronger and heavier structure to hold the glazing in place after installation, and often involves some form of proprietary framing system.

An additional disadvantage is the relatively low light transmission through the glazing material. Up to 20% loss of light transmission has been observed. The pressure created in filling the cavity between the glass panels also creates a deformation of the gel. The resulting optical refraction and reflection creates distortion of the view through the glazing panel.

Furthermore, the filling of the cavity between the glass panels requires an enormous amount of attention and precision. If the cavity is not filled properly, or the adhesion between the applied primer and the gel is not exact, air bubbles in the gel will appear. Such air bubbles distort visibility through the glazing panel.

This prior art type of fire protection glazing also has a high degree of sensitivity to high and low temperatures. Because of this sensitivity, an installation of the glazing in environments which will be subjected to temperatures below approximately −18° Celsius (5° F.) and above +60° Celsius (140° F.) is not recommended. The fire protection gel will crystallize at temperatures lower than −18° C. and therefore lose its transparency. At temperatures above +60° C. the possibility exists of a premature reaction turning of the gel layer opaque. Such premature reaction of the fire protection gel can even be observed in panels directly exposed to sun light. Where an exterior application requires an installation of this type of glazing material, an additional pane of insulation glass has to be installed in front of the fire protection glazing. The additional glass not only increases the cost and the weight of the total structure but also lowers the light transmission through the glazing material.

Another currently available technology is the installation of a thin, transparent fire protection film between two or more glazing panels in a sandwich or laminated structure. The fire protection rating is determined by the number of glass panels aligned in series. In some instances a dead air space or vacuum between the glass panels is required to achieve a high fire resistancy. Such a laminated construction does not provide a vacuum or a dead air space within the individual panels so that multiple panels must be used in series.

This technology also produces a weight of approximately 12 pounds per square foot and the same disadvantage concerned with weight as the previously discussed prior art structure.

An additional disadvantage is that the additional layer may reduce the light transmission as much as 35%.

The danger of breakage due to the multiple glazing panels is apparent. The handling and transportation therefore requires maximum attention to reduce the amount of loss both in the manufacturing process and on the construction site before and during installation. This hazard is further increased because the product is often installed by unqualified workmen who do not fully understand the need to take special precautions against damage or breakage.

Again this sandwich construction often has sensitivity to temperatures below −18° C. and above +60° C.

THE NATURE OF THE PRESENT INVENTION

The present invention provides solutions to the problems with prior art fire protection glazing materials. More specifically, the present invention is designed to be the first real fire insulation protection glass unit, to reduce the weight per square foot, reduce the breakage, increase the transportability and handling, increase the light transmission, increase the temperature ranges and combine different materials for other applications without increasing the thickness of the units.

The heart of the invention is, that the fire protection material which is capable of making the panel opaque to radiation will be installed between and at the perimeter k panes of glazing material in a solid, liquid or gel-like form which maintains its form until a predetermined certain reaction temperature is reached in the pane, or will be actively inserted into the space between the sheets of glass at a predetermined temperature. In the solid form, the fire protection material also may be the spacer, or part of the spacer, between the glass panes. Because the fire protection material is located peripherally of the panels in the spacers or as part of the spacers between the transparent panes but around its perimeter in the supported region it does not obstruct visibility through the transparent pane and is also not exposed to direct sun light or any source of radiant heat. The fire protection material will only be activated when in case of a fire the predetermined reaction temperature is reached in the panel. When this reaction temperature is reached, the fire protection material will expand and fill the cavity between the individual panes of transparent glazing material by the process of intumescence or be injected into unfilled space when a predetermined amount of heat is applied to the window. The expanded material will then create a barrier opaque to radiant energy between the fire and the unexposed side of the panel.

Preferably the fire protection material is placed only within a cavity of the spacer in the panel in a liquid, solid or gel-like form so that the weight per square foot of panel will be reduced dramatically. A weight reduction (of more than 80% in some cases) ensures an easier transportation, handling and installation of the panels or panel units, reduces the cost of transportation and reduces the possibility of breakage during handling. The dramatic weight reduction has also the advantage of installing the glazing in lighter constructed framing systems and does not require any proprietary framing systems. It is also easier to handle without the use of specially trained workmen.

In addition the installation of the fire protection material in the spacer will have the advantage of not reducing the light transmission through the transparent panes. No material is located between the transparent panels other than dead air space, or gases. The level of visibility through the transparent panels will be determined only by the transparent material used.

Moreover the use of the new fire protection material is possible in applications with exposure to higher temperatures, where until now only glazing with additional insulation glass could be installed, if it were to be used at all. The novel fire protection glazing of the invention can also be installed in areas where very low temperatures are present. The range of application in areas with very high and very low temperatures will be dramatically increased. In particular no material is between the individual panes which will crystalize at low temperatures.

This is the first real insulation glass unit which will save energy because of its high R value, and has high sound reduction capacities.

An additional advantage of the invention is that the cavity between the individual panes of a transparent material will be closed at a certain reaction temperature. This means that the intumescent fire protection material will create an effective radiation opaque layer without the need of any special expenditure. Furthermore, the intumescent material can also be installed between all kinds of materials of transparent panels. Such materials include plastics, polycarbonates, glass clad polycarbonates, annealed glass, float glass, ceramic glass, laminated glass, tempered glass and any mixture and combination of transparent materials. The invention ensures the insulation of the cavity between two or more panes of transparent materials.

The invention includes all types and styles of spacers enclosing a space between transparent panes. The spacers can be installed between the panes of a transparent unit around its perimeter for the purpose of spacing the individual panes apart. Preferred spacers, for example, of hollow channel form not only provide an exact spacing of the transparent panels but also the storage for the fire protection material in positions that it will not obscure visibility. Such a spacer ensures easy manufacture of the transparent panes of the present invention.

With the help of a sealant the transparent panes not only are securely attached to each other to a high insulation glass unit, but also entirely sealed so that neither air nor any other gas can enter or escape. Sealing ensures that the cavity between the individual transparent panels is entirely sealed and that no air can either escape or enter the cavity.

BRIEF DESCRIPTION OF THE DRAWINGS

The following drawings show a preferred embodiment of the present invention wherein.

SPECIFIC DESCRIPTION OF A PREFERRED EMBODIMENT OF THE INVENTION

Figure 1:
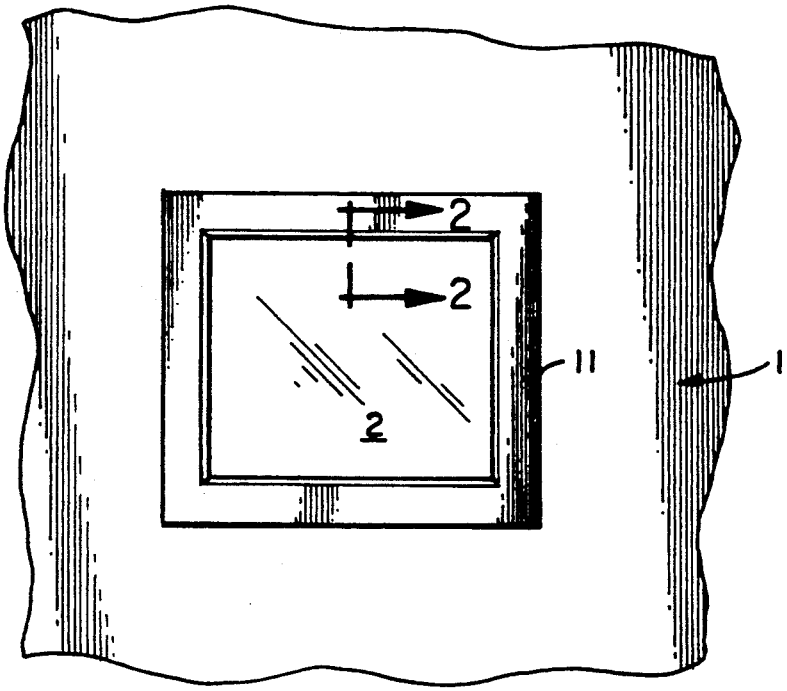
FIG. 1 is a partial elevational view of a portion of a fire barrier containing fire protection glazing.

FIG. 1 illustrates a fire barrier such as a door 1 containing a window 2 employing fire protection glazing in accordance with the present invention. A mounting frame 11 is provided on each side of an opening in the door 1 to permit mounting of the fire protection glazing in the door and to complete the fire barrier. It is understood that the materials used in the door 1 and the framing 11 are selected to be appropriate under the various fire codes to retard the spread of fire, flames, smoke and heat.

Figure 2:
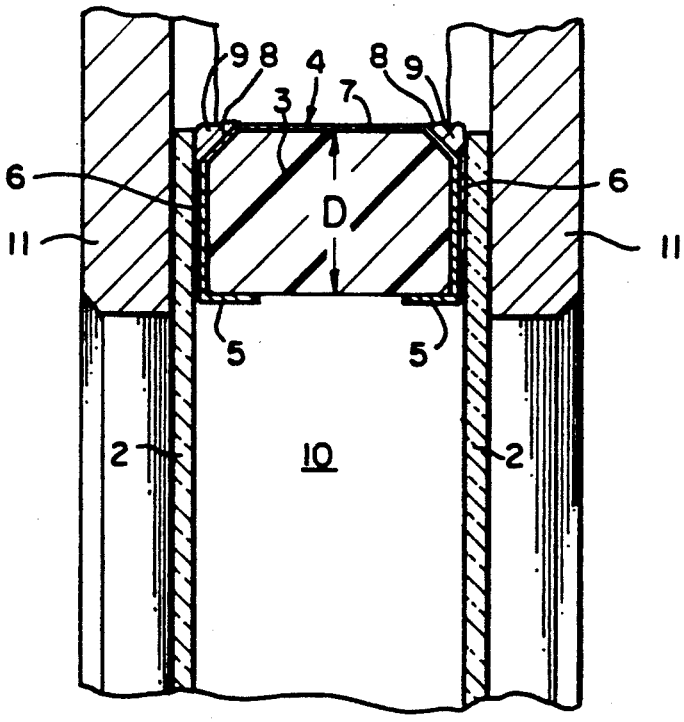
FIG. 2 is an enlarged partial sectional view taken along line 2—2 of FIG. 1 illustrating details of the fire barrier protection glazing.

The nature of the structure of the present invention is best seen in the sectional view of FIG. 2. As seen in that figure, transparent panels 2 of glass or other suitable transparent material are spaced apart by a spacer frame 4 which in preferred forms may run continuously around the perimeter of the glass panels 2. As seen in this preferred form the spacer is a channel member having side walls 6 and a connecting web 7. In this embodiment it is provided with folded back portions 5 partially closing the opened side of the channel, which otherwise faces inwardly toward the opened unfilled space 10 between the panes of glass 2. Since the dead space between the glass panes 2 may be dictated by fire code and other considerations, the depth of the channel D is selected to provide sufficient space to contain a fire protection material of the type employed in the present invention. Preferably this material is in the form of a solid or gel. The structure may then be completed by sealing the edges of the panes 2 and the spacer frame 4. In this particular embodiment this is facilitated by providing chamfered edges 8 between the side wall 6 and the channel web 7 in which adhesive 9 may be applied liberally to seal the spacer to the glass panes. The sealer, of course, may be external surfaces as well and other types of sealing or clamping may optionally be employed.

It will be understood that the space 10 between the panes may be evacuated or filled with any type of gas, including air. The fire protection material 3 within the channel when heated to a predetermined temperature by the heating of the glass panels and the door structure in general will cause a change in state of the fire protection material, including an expansion or intumescence into the cavity. The fire protection material thus is arranged at the edge of the cavity and out of sight, i.e., is not interposed between the panes of glass or visible within the area seen through the support frame and in no way will obstruct vision until intumescence occurs. The fire protection material includes a material which will adhere to the interior of the glass plates and cause them to be opaque or semi-opaque thereby preventing light to pass through. Any type of material may be selected, but a ceramic material or coal dust may perform this function of providing opaqueness. A rapidly expanding material effectively blowing the opaque material into the cavity by the intumescence action is another ingredient of the fire protection material. Other constituents may include materials assuring good thermal properties so that the intumescence material will react at the desired temperature. If the intumescence material lacks sufficient binding capabilities to hold the material together in the channel and this is not provided by the thermal material a separate binder may be added to hold all of the constituents into the channel. It may be possible and would be ideal to use a single intumescence material having all of the desired properties as well, but that is not necessary in accordance with the invention. All that is required is that a finely divided material to provide opaqueness and a material to provide intumescence be deployed in a compact solid, liquid or gel condition between the panels at the edges and that heat transference cause intumescence at a predetermined temperature.

It is possible that the fire protection material itself will be sufficiently strong and self-supporting to provide the spacer between the plates of glass or other transparent material in some applications. It may even be possible that some such material may be self-sealing or sealable to the glass without use of a separate sealant. All such possibilities are intended to be within the scope of the invention as claimed.

The invention also concerns the method of disposing intumescence and finely divided opaque material at an edge of a fire protection panel that consists of spaced-apart panes of transparent material. Upon heating to a predetermined temperature, the intumescence material expands or explodes into the cavity with the opaque material and prevents further transmission of light, smoke, flames or heat radiant energy through the panels.

Various embodiments of the invention have been suggested. Others will occur to those skilled in the art. All such embodiments are intended to be within the scope and spirit of the claims.

I claim:

1. Fire protection glazing comprising:

at least two generally parallel transparent panes;

a spacer between said two transparent panes at their perimeter enclosing space between the panes and providing a means to hold fire protection material which includes an intumescent material and opaque finely divided material in a solid, gel or liquid form and which reacts at a certain temperature and expands by intumescence into the space between the transparent panel to render the transparent panes opaque to light and heat energy; and means to hold the panes and the spacer in place relative to one another.

2. The fire protection glazing of claim 1 in which the spacer is composed of fire protection material.

3. The fire protection glazing of claim 1 in which the spacer is hollow and contains a fire protection material in a solid, gel or liquid form which reacts at a predetermined temperature and expands by intumescence into the space between the transparent.

4. The fire protection glazing of claim 3 in which the spacer is composed of fire protection material.

5. The fire protection glazing of claim 1 in which the spacer is in the form of a hollow space enclosing frame and the intumescent material and opaque finely divided material is supported in the hollow space.

6. The fire protection glazing of claim 5 in which the cavity between the transparent panes and the spacer is filled with any type of gas.

7. The fire protection glazing of claim 5 in which the cavity between the transparent panes and the spacer is evacuated.

8. The fire protection glazing of claim 5 in which the spacer consists at least in part of inward facing channel members which provide the material containing hollow.

9. The fire protection glazing of claim 8 in which the spacer is a hollow frame of the size of the panes composed of inwardly facing channel pieces which is secured to both panes.

10. The fire protection glazing of claim 8 in which the spacer is a hollow frame of the size of the panels comprised of inwardly facing channel pieces which is secured to both panels by adhesive.

11. The fire protection glazing of claim 10 in which the edges between the side walls and the web of the channels are chamfered to provide space for adhesive to secure the channels to the panes.

12. The fire protection glazing of claim 11 in which the open side of each channel is partially closed to afford better containment of the intumescent and opaque materials.

13. The method of providing fire protection comprising:

providing a spacer for use between transparent panes and placing within a hollow of that spacer an intumescent material and an opaque finely divided material which assumes a solid form capable of reacting and expanding into the space beyond the panes at a certain temperature.

14. The method of claim 13 in which the intumescent material and opaque finely divided material are placed in hollows of the spacer for use between panes of transparent material and then the spacer is put in place between the panes.

15. The method of claim 13 in which the intumescent material and opaque finely divided material are placed in a channel spacer frame of the dimension of the panes to be separated wherein the channels face inwardly of the frame and the panes and separated frame are placed together and secured together.

16. The method of claim 15 in which an adhesive is applied between the frame and the panes to hold them together as a unit.

17. The method of providing fire protection comprising:

placing at the peripheral edges of parallel arranged panes so as to lie between them an intumescent material and an opaque finely divided material in a solid form which reacts at a certain temperature; and raising the temperature to the reaction temperature of the intumescent material so that it expands with the opaque material into the space between the plates and provides a barrier against light and heat radiation.

* * * * *